United States Patent [19]

Okumura et al.

[11] Patent Number: 4,863,844

[45] Date of Patent: Sep. 5, 1989

[54] GOLD AND SULFUR SENSITIZED SILVER HALIDE LIGHT-SENSITIVE PHOTOGRAPHIC MATERIAL

[75] Inventors: Mitsuhiro Okumura; Keiji Ohbayashi; Shigeo Tanaka, all of Hino, Japan

[73] Assignee: Konica Corporation, Tokyo, Japan

[21] Appl. No.: 121,470

[22] Filed: Nov. 17, 1987

[30] Foreign Application Priority Data

Nov. 22, 1986 [JP] Japan ..... 61-279347
Oct. 1, 1987 [JP] Japan ..... 62-249316

[51] Int. Cl.[4] ..... G03C 1/34; G03C 1/10; G03C 1/08

[52] U.S. Cl. ..... 430/569; 430/603; 430/605; 430/611

[58] Field of Search ..... 430/569, 611, 603, 605

[56] References Cited

U.S. PATENT DOCUMENTS 4,542,094 9/1985 Koshizuka et al. ..... 430/569

FOREIGN PATENT DOCUMENTS 2165955 4/1986 United Kingdom .

*Primary Examiner*—Richard L. Schilling
*Attorney, Agent, or Firm*—Jordan B. Bierman

[57] ABSTRACT

A silver halide light-sensitive photographic material which is excellent in the aptitude for rapid processing and highly sensitive and of which the sensitivity and gradation are stable against the change of the temperature at the time of exposure is disclosed. The silver-halide photographic material comprises a support and, provided thereon, a silver halide emulsion layer, wherein said silver halide emulsion layer contains silver chloro-halide grains containing not less than 90 mole % of silver chloride and having been chemically sensitized in the presence of a labile sulfur compound and a gold compound, and an organic compound of which solubility product (Ksp) with a silver ion is not more than $1\times10^{11.0}$, said organic compound having been added to said silver halide emulsion layer during the period between after the formation of said silver halide grains and before the completion of the chemical sensitization thereof.

9 Claims, No Drawings

GOLD AND SULFUR SENSITIZED SILVER HALIDE LIGHT-SENSITIVE PHOTOGRAPHIC MATERIAL

FIELD OF THE INVENTION

The present invention relates to a silver halide light-sensitive photographic material which is excellent in the aptitude for rapid processing and highly sensitive and of which the sensitivity and gradation are so stable as to be hardly affected by changes in the temperature at the time of exposure.

BACKGROUND OF THE INVENTION

In recent years, further increasing the speed of the color developing process has been demanded for the purpose of improving the photographic print productivity and also for other purposes, and various measures are devised in order to meet such the demand. A method known as one of such measures is the use of a color development accelerator in the case where the development of an exposed silver halide light-sensitive photographic material is developed by using an aromatic primary amine color developing agent. Examples of such the color development accelerator include those compounds as described in U.S. Pat. Nos. 2,950,970, 2,515,147, 2,496,903, 4,038,075, 4,119,462, British Pat. Nos. 1,430,998 and 1,455,413, Japanese Patent Publication Open to Public Inspection (hereinafter referred to as Japanese Patent O.P.I. Publication) Nos. 15831/1978, 62450/1980, 62451/1980, 62452/1980, 62453/1980 and 12422/1976, and Japanese Patent Examined Publication Nos. 12422/1976 and 49728/1980. However, as a result of our investigation, most of these compounds have been found out inadequate in the development acceleration effect, and even the rest showing an adequate development acceleration effect have been found disadvantageous in respect of producing a fog, thus being considered of no practical use.

Also, in order to accelerate the permeation of a color developing agent into a silver halide light-sensitive photographic material, various permeating agents have been examined. Of these agents, for example, benzyl alcohol is added to a color developer solution to accelerate the color development. This method is generally extensively used.

This method, however, has a drawback in some degree to rapid processing because it needs a processing at as high a temperature as 33° C. for more than three minutes in order to obtain adequately high color-formed densities. In addition to the developing temperature, a method of increasing the pH concentration of a color developer solution to improve the color development is also proposed. This method, however, is also disadvantageous in respect that if, for example, the pH is raised to not less than 10.5, then the oxidation of a color developing agent is significantly accelerated, or the color developing agent is subject to pH changes because of no appropriate buffer solution being available, thus making it difficult to obtain stable photographic characteristics or increasing the dependence of the photographic characteristics upon processing time.

On the other hand, to make the color development more rapid, there is known a method as described in, e.g., U.S. Pat. No. 3,719,492, in which a color developing agent is in advance incorporated in a light-sensitive material.

This method, however, has the disadvantage that the silver halide light-sensitive photographic material containing a color developing agent is poor in the preservability tends to be fogged before being used, and further tends to be fogged also at the time of being color-developed.

In addition, to make the amine portion of such a color developing agent inactive, there are those methods in which the color developing agent is made in the form of, for example, a Schiff's salt to be incorporated into a light-sensitive material as described in, e.g., U.S. Pat. No. 3,342,559 and Research Disclosure No. 15159 in 1976. These methods, however, have the disadvantage that color development starts only after the alkali hydrolysis of the color developing agent, so that the color development is rather retarded.

Further, Japanese Patent O.P.I. Publication No. 64339/1981 discloses a method of incorporating a specific structure having 1-aryl-3-pyrazolidone into a silver halide color photographic material; and Japanese Patent O.P.I. Publication Nos. 144547/1982, 50532/1983, 50533/1983, 50534/1983, 50535/1983 and 50536/1983 disclose that the in advance incorporation 1-aryl-pyrazolidones into a silver halide light-sensitive photographic material enables to develop the photographic material in a very short period of time.

However, such techniques described in these publications are not necessarily considered satisfactory in respect of obtaining an adequate color developing speed and a dye image having high color densities, thus leaving room for further improvement.

Further, it is also known that the progress of the color development can be more sped up by using a silver chloride emulsion or a high silver chloride-content silver chlorobromide emulsion as the silver halide emulsion of a lightsensitive photographic material. Descriptions related to this technique can be found in, e.g., U.S. Pat. Nos. 4,183,756 and 4,225,666, and Japanese Patent O.P.I. Publication Nos. 26589/1980, 91444/1980, 95339/1983, 94340/1983, 95736/1983, 106538/1983, 107531/1983, 107532/1983, 107533/1983, 108533/1983, 125612/1983, and the like. The techniques described in these publications, although considered fairly satisfactory from the standpoint of their aptitude for rapid processing. have the disadvantage that they are still not good enough to provide adequate sensitivities, and particularly the emulsion shows significantly unstable changes in the sensitivity and gradation due to changes in the temperature at the time of exposure of the resulting light-sensitive material.

In the case where a labile sulfur compound and a gold compound are used in the chemical sensitization of a high silver chloride-content emulsion for the purpose of highly sensitizing the same, the above-mentioned changes in the sensitivity and gradation according to changes in the temperature at the time of exposure becomes even larger, which fact has been found out to be a large hindrance to practical use.

As a result of our continued investigation to solve the above-mentioned problems, we have now found the unexpected fact that where a specific high silver chloride-content emulsion is chemically sensitized by using the above-mentioned labile sulfur compound and gold compound, when a specific mercapto-type compound is further applied to the emulsion, a stable silver halide light-sensitive photographic material whose sensitivity and gradation are hardly affected by changes in the temperature at the time of exposure can be obtained. Thus the present invention has now been made.

SUMMARY OF THE INVENTION

It is therefore an object of the present invention to provide a silver halide light-sensitive photographic material which is excellent in the aptitude for rapid processing and whose sensitivity and gradation are so stable as to be hardly affected by changes in the temperature at the time of exposure.

The above object of this invention is accomplished by a silver halide light-sensitive photographic material comprising a support and, provided thereon, a silver halide emulsion layer, wherein said silver halide emulsion layer contains silver chloro-halide grains containing not less than 90 mole % of silver chloride and having been chemically sensitized in the presence of a labile sulfur compound and an organic compound of which solubility product (Ksp) with a silver ion is not more than $1\times10^{-11.0}$, said organic compound having been added to said silver halide emulsion layer during the period between after the formation of said silver halide grains and before the completion of the chemical sensitization thereof.

DETAILED DESCRIPTION OF THE INVENTION

In the silver halide light-sensitive photographic material of this invention, the silver halide grains contained in at least one of the silver halide emulsion layers thereof are silver halide grains whose silver chloride content is as high as not less than 90 mole %, and further the preferred silver chloride content for the effect of this invention is in the range of from 99.0 mole % to 99.9 mole %, which satisfies both the effect of this invention and the aptitude for rapid processing at the same time.

The silver halide of this invention may be any one of silver chlorobromide, silver iodochloride, silver chloroiodobromide and silver chloride, and silver iodide is allowed to be contained in the silver halide, but the silver iodide content of the silver halide is preferably not more than 1 mole %, more preferably not more than 0.5 mole %, and most preferably zero mole %. Therefore, the silver halide of this invention is preferably silver chlorobromide or silver chloride, and most preferably silver chlorobromide having the above-mentioned silver chloride content.

The silver halide grains of this invention may be used mixing with non-invention silver halide grains, but in that case, the proportion of the projection area occupied by the silver halide grains of this invention to the projection area occupied by the whole silver halide grains of the silver halide emulsion layer containing the silver halide grains of this invention is preferably not less than 50%, and more preferably not less than 75%.

The silver halide grain of this invention may be formed in accordance with any one of those methods described in, e.g., Japanese patent O.P.I. Publication Nos. 162540/1984, 48755/1984, 222844/1985, 222845/1984, 136735/1985, and the like.

The grain size of the silver halide grain of this invention, although not particularly restricted, to take into account the aptitude for rapid processing and sensitivity and other photographic characteristics, may be preferably 0.2 μm to 1.6 μm, and more preferably 0.25 μm to 1.2 μm. The above grain size can be measured by any of various methods being generally used by those skilled in the art. Typical ones of such methods are described in Loveland 'Analytical Methods for Grain Sizes', A.S.T.M. Symposium on Light Microscopy, 1955, pp. 94–122, and in Section II of, Mees and James, 'Theory of the Photographic Process' 3rd. ed., MacMillan (1966). The grain size can be measured using the projection area of or an approximate value of the diameter of the grain. If silver halide grain sizes are of a substantially uniform conformation, the grain size distribution of such grains can be fairly precisely expressed as of their diameters or projection areas.

The grain size distribution of the silver halide grains of this invention may be of the either monodisperse type or polydisperse type. The silver halide grains of this invention are preferably monodisperse silver halide grains which, in the grain size distribution of the grains, have a coefficient of variation of not more than 22%, and more preferably not more than 15%, wherein the coefficient of variation is a quantity in terms of percentage of the quotient obtained by dividing the standard deviation of the grain size distribution by the average grain size (the arithmetic mean value of grain sizes).

The term 'the grain size' herein, in the case of a spherical silver halide grain. is its diameter and, in the case of a cubic or nonspherical silver halide grain, is the diameter of a circular image corresponding in the area to its projection image.

The silver halide grains of this invention may be those obtained according to any of the acidic method, neutral method and ammoniacal method. The grains may be grown at a time or may, after preparing seed grains, be grown from the seed grains. The procedures of preparing seed grains and growing them may be either the same or different.

The procedure of making a water-soluble silver salt react with a water-soluble halide may be made according to any of the orderly mixing method, inversely mixing method, simultaneously mixing method, and combination of these methods. Out of these methods, the simultaneously mixing method is preferred. Further, as one form of the simultaneously mixing method, the pAg-controlled double jet method described in Japanese Patent O.P.I. Publication No. 48521/1979 may also be used.

Further, if necessary, a silver halide solvent such as thioether or a crystal habit control agent such as a mercapto group-containing compound or sensitizing dye may also be used.

The silver halide grain of this invention may be of any arbitrary conformation. One preferred example of the conformation is a cube having a {100} face as a crystal surface. Also, the grain may be in the octahedral, tetradecahedral or dodecahedral form produced according to those methods as described in U.S. Pat. Nos. 4,183,756 and 4,225,666, Japanese Patent O.P.I. Publication No. 26589/1980, Japanese Patent Examined Publication No. 42737/1980, and 'The Journal of Photographic Science' 21, 39 (1973), and the like.

The silver halide grains of this invention may consist of grains having a single conformation or may be a mixture of various grains different in the conformation.

The silver halide grain of this invention may contain thereinside and/or on the surface thereof metallic ions by adding thereto a cadmium salt, zinc salt, lead salt, thalium salt, iridium salt or complex salt, rhodium salt or complex salt, or iron salt or complex salt in the course of forming and/or growing the grain, or may have thereinside and/or on the surface thereof a reduction sensitization nucleus by being placed in an appropriate reductive atmosphere.

The emulsion of this invention may either have useless water-soluble salts removed therefrom after completion of the growth of silver halide grains or have the salts remain unremoved. Removal of such salts may be made according to the method described in Research Disclosure 17643.

The silver halide grain of this invention may be either one to have a latent image formed principally on its surface or one to have a latent image formed principally thereinside, and is preferably the one to have a latent image formed principally on its surface.

In the present invention, the silver halide emulsion containing the above-mentioned silver halide grains of this invention is an emulsion chemically sensitized in the presence of both a labile sulfur compound and a gold compound, and the emulsion also contains additionally at least one compound selected from the group consisting of organic compounds having a physical property value of $1\times10^{-11.0}$ as the solubility product (Ksp) of it and silver ions, the said organic compound being added during the period from upon the formation of the silver halide grains up to completion of the chemical sensitization.

Any of non-invention compounds having a value exceeding $1\times10^{-11.0}$ as the solubility product of it with silver ions; i.e., a compound less capable of forming a salt with silver ions than the compound of this invention, is not good enough to allow expectation of the desired effect of this invention. Reference can be made to the 'Shin Jikken Kagaku Koza (New Experimental Chemistry Course) Vol. 1' (Maruzen Ltd.) pp. 233–250 for the measurement and calculation of the solubility product.

In the present invention, the above-mentioned organic compound having a physical property value of not more than $1\times10^{-11.0}$ as the solubility product of it and of silver ions (hereinafter referred to as the organic compound of this invention) is preferably one of those compounds having the following Formula [S]:

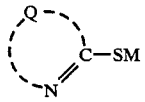

wherein Q is a group of atoms necessary to form a 5-member or 6-member heterocyclic ring or a benzene ring-condensed 5-member or 6-member heterocyclic ring, and M is a hydrogen atom or a cation.

Those mercapto compounds represented by Formula [S], which may be suitably usable as the organic compound of this invention, will be described below:

In Formula [S], the Q, as mentioned above, represents a group of atoms necessary to form a 5-member or 6-member heterocyclic ring or a benzene ring-condensed 5-member or 6-member heterocyclic ring, and examples of the heterocyclic ring formed by the Q include imidazole ring, tetrazole ring, thiazole ring, oxazole ring, selenazole ring, benzimidazole ring, naphthoimidazole ring, benzothiazole ring, naphthothiazole ring, benzoselenazole ring, naphthoselenazole ring, benzoxazole ring, and the like.

Examples of the cation represented by the M include alkali metallic ions (such as sodium ion, potassium ion, etc.) and an ammonium group, and the like.

The mercapto compounds of Formula [S] are more desirable to be those mercapto compounds having the following Formulae [SA], [SB], [SC] and [SD]:

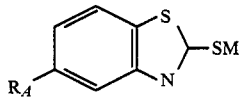

wherein $R_A$ is a hydrogen atom, an alkyl group, an alkoxy group, an aryl group, a halogen atom, a carboxyl group or a salt thereof, a sulfo group or a salt thereof, or an amino group; Z is —NH—, —O—, or —S—; and M is the same as the M as defined in Formula [S].

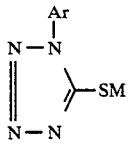

wherein Ar represents

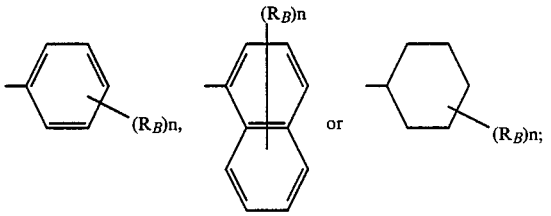

$R_B$ is an alkyl group, an alkoxy group, a carboxyl group or a salt thereof, a sulfo group or a salt thereof, a hydroxyl group, an amino group, an acylamino group, a carbamoyl group or a sulfonamido group; n is an integer of 0 to 2; and M is as defined in the M of Formula [S].

In Formulas [SA] and [SB], the alkyl group represented by the $R_A$ or $R_B$ is, for example, a methyl, ethyl, butyl or the like group, and the alkoxy group is, for example, a methoxy group, ethoxy group, or the like, and the salt of the carboxyl or sulfo group is, for example, a sodium salt, ammonium salt, or the like.

In Formula [SA], the aryl group represented by the $R_A$ is, for example, a phenyl or naphthyl group, and the halogen atom is, for example, a chlorine atom, bromine atom or the like.

In Formula [SB], the acylamino group represented by the $R_B$ is, for example, a methylcarbonylamino group, benzoylamino group, or the like, and the carbamoyl group is, for example. an ethylcarbamoyl group, phenylcarbamoyl group, or the like, and the sulfonamido group is, for example, a methylsulfonamido group, phenylsulfonamido group, or the like.

The above-mentioned alkyl, alkoxy, aryl, amino, acylamino, carbamoyl and sulfonamido groups include those each having further a substituent.

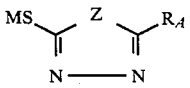

Formula [SC]

wherein Z is a

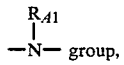

an oxygen atom or a sulfur atom; R is a hydrogen atom, an alkyl group, an aryl group, an alkenyl group, a cycloalkyl group, a —$SR_{A1}$ group, a

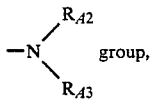

group, —$NHCOR_{A4}$ group, a —$NHSO_2R_{A5}$ or a heterocyclic group; $R_{A1}$ is a hydrogen atom, an alkyl group, an alkenyl group, a cycloalkyl group, an aryl group, a —$COR_{A1}$ group, or a —$SO^2R_{A5}$ group; $R_{A2}$ and $R_{A3}$ each is a hydrogen atom, an alkyl group or an aryl group; $R_{A4}$ and $R_{A5}$ each is an alkyl group or an aryl group; and M is as defined in the M of Formula [S].

The alkyl group represented by the RA, RA1, RA2, RA3, RA4 or RA5 in Formula [SC] is, for example, a methyl group, benzyl group, ethyl group, propyl group or the like, and the aryl group is a phenyl group, naphthyl group, or the like.

The alkenyl group represented by the RA or RA1 is, for example. a propenyl group or the like, and the cycloalkyl group is, for example, a cyclohexyl group or the like, and the heterocylic group represented by the $R_A$ is, for example, a furyl group, pyridinyl group, or the like.

These alkyl and aryl groups represented by the above $R_A$, $R_{A1}$, $R_{A2}$, $R_{A3}$, $R_{A4}$ and $R_{A5}$, these alkenyl and cycloalkyl groups represented by the $R_A$ and $R_{A1}$ and these heterocyclic groups represented by the $R_A$ include those each having a further substituent.

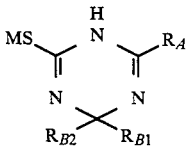

wherein $R_A$ and M represent the same groups as defined in the $R_A$ and M, respectively, of Formula [SC]; and $R_{B1}$ and $R_{B2}$ represent the same groups as defined in the $R_{A1}$ and $R_{B2}$, respectively, of Formula [SC], provided that the $R_{B1}$ and $R_{B2}$ are allowed to form a ring by combining with each other.

The following are examples of the compounds represented by Formula [S]. The present invention is not limited to and by the examples.

SA-1

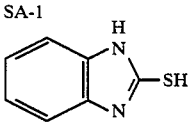

SA-2

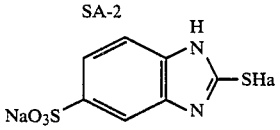

-continued

SA-3

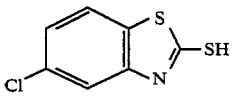

SA-4

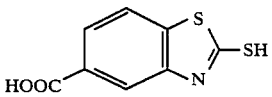

SA-5

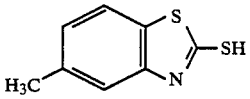

SA-6

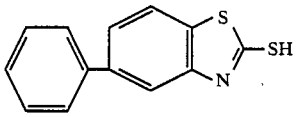

SA-7

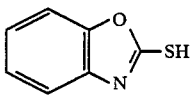

SA-8

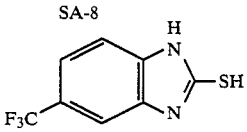

SB-1

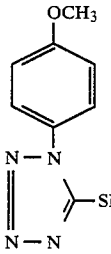

SB-2

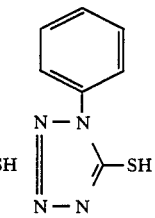

SB-3

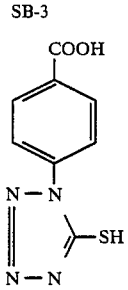

SB-4

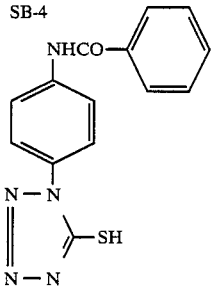

SB-5

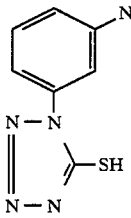

SB-6

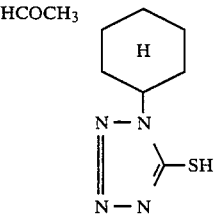

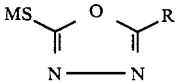

Exemplified

-continued
| compound | R | M |
|---|---|---|
| SC-1 | $-C_2H_5$ | —H |
| SC-2 | $-CH_2-CH=CH_2$ | —H |
| SC-3 | $-CH=CH-CH_2-CH_3$ | —H |
| SC-4 | $-C_7H_{15}$ | —H |
| SC-5 | $-C_9H_{19}$ | —Na |
| SC-6 | 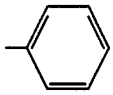 | —H |
| SC-7 | $-C_4H_9(t)$ | —H |
| SC-8 | 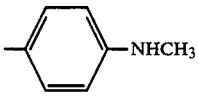 | —H |
| SC-9 | 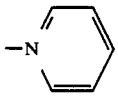 | —H |
| SC-10 | 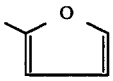 | —H |
| SC-11 | 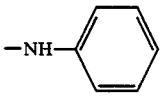 | —H |
| SC-12 | 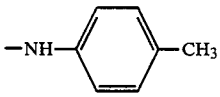 | $-NH_4$ |
| SC-13 | $-NHCOCH_3$ | —H |
| SC-14 | 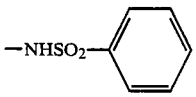 | —H |
| SC-15 | $-N(CH_3)_2$ | —H |
| SC-16 | 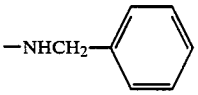 | —H |
| SC-17 | 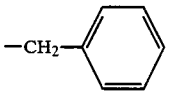 | —H |
| SC-18 | $-S-CH_3$ | —H |
| SC-19 | 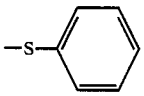 | —H |
| SC-20 | —SH | —H |
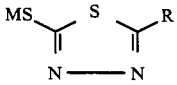
Exemplified -continued
| compound | R | M |
|---|---|---|
| SC-21 | —H | —H |
| SC-22 | $-C_2H_5$ | —H |
| SC-23 | $-C_4H_9(t)$ | —H |
| SC-24 | $-C_6H_{13}$ | —H |
| SC-25 | 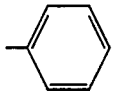 | —H |
| SC-26 | 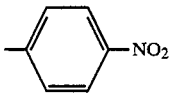 | —H |
| SC-27 | 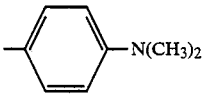 | —H |
| SC-28 | 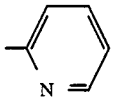 | —H |
| SC-29 | 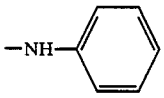 | —H |
| SC-30 | $-NH_2$ | —H |
| SC-31 | $-CH_2CH{=}CH_2$ | —H |
| SC-32 | —SH | —H |
| SC-33 | $-NHCOC_2H_5$ | —H |
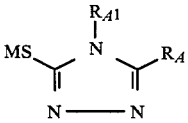
| Exemplified compound | $R_A$ | $R_{A1}$ | M |
|---|---|---|---|
| SC-34 | $-C_2H_5$ | —H | —H |
| SC-35 | $-CH_3$ | $-CH_3$ | —H |
| SC-36 | $-CH_3$ | 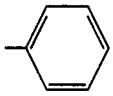 | —H |
| SC-37 | $-NHCOCH_3$ | $-CH_3$ | —H |
| SC-38 | 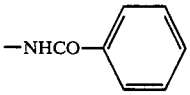 | 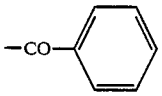 | —H |
| SC-39 | $-NHCOCH_3$ | $-COCH_3$ | —H |
| SC-40 | $-NHCOCH_3$ | 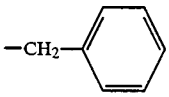 | —H |
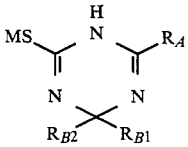

-continued

| Exemplified compound | $R_A$ | $R_{B1}$ | $R_{B2}$ | M |
|---|---|---|---|---|
| SD-1 | $-C_2H_5$ | $-CH_3$ | $-CH_3$ | $-H$ |
| SD-2 | 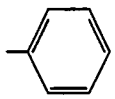 | $-CH_3$ | $-CH_3$ | $-H$ |
| SD-3 | $-NH_2$ | $-H$ | 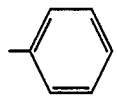 | $-H$ |
| SD-4 | 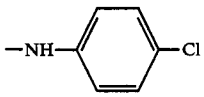 | $-H$ | $-C_4H_9$ | $-H$ |
| SD-5 | $-NHCOCH_3$ | $-CH_3$ | $-CH_3$ | $-H$ |
| SD-6 | 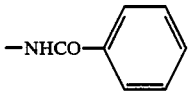 | $-CH_3$ | $-CH_3$ | $-H$ |
| SD-7 | 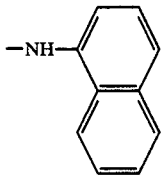 | $-CH_3$ | $-C_3H_7(i)$ | $-H$ |
| SD-8 | 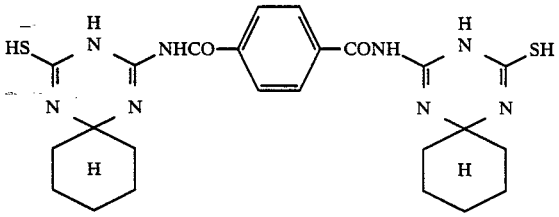 | | | |

The compounds represented by the above formula [S] include those compounds described in e.g., Japanese Patent Examined Publication No. 28496/1965; Japanese Patent O.P.I. Publication No. 89034/1975; J. Chem. Soc. 49, 1748 (1927) and 42378 (1932); J. Org. Chem. 39, 2469 (1965); U.S. Pat. No. 2,482,001; J. Chem. Soc. 1723 (1951); Japanese Patent O.P.I. Publication No. 111846/1981; British Pat. No. 1,275,701; U.S. Pat. Nos. 3,266,897 and 2,403,927, and the like, and these compounds can be synthesized according to those methods described in these publications.

In order to incorporate any of these compounds having Formula [S] of this invention (hereinafter referred to as Compounds [S]) into a silver halide emulsion layer containing the silver halide grains of this invention, the compound is first dissolved into water or an organic solvent which is discretionary miscible with water (such as, e.g., methanol, ethanol), and then the solution is added to the emulsion. Compounds [S] may be used alone, or two or more different compounds having the same Formula [S] may be used in combination, or these may be used in combination with other stabilizers or antifoggants not belonging to Formula [S].

The addition of Compounds [S] may be made at any discretional point of time during the period from immediately after the formation of the silver halide grains up to completion of the chemical sensitization, and preferably at a point of time soon after the commencement of the chemical sensitization following the formation of the grains.

Compounds [S] may be added either all at a time or by several installments.

The adding amount of Compounds [S], although not particularly restricted, is normally from $1\times10^{-6}$ mole to $1\times10^{-1}$ mole per mole of silver halide, and more preferably from $1\times10^{-5}$ mole to $1\times10^{-2}$ mole.

The silver halide grains of this invention are chemically sensitized in the presence of both a labile sulfur compound and a gold compound. The labile sulfur compound and gold compound to be used in this invention will be described below:

The labile suflur compound to be used in this invention is a sulfur-containing compound that forms a silver salt when reacting with a silver halide, and further has such a nature as to form silver sulfide under a strong alkaline condition, and examples of the compound include thiosulfates. arylthiocarbamides, thiourea, arylisothiocyanates, cystine, and the like.

The using quantity of the above-mentioned labile sulfur compound of this invention as a suflur sensitizer differs according to various conditions, but is used in the range of preferably from $1\times10^{-7}$ mole to $1\times10^{-1}$ mole per mole of silver halide, more preferably from $1\times10^{-7}$ mole to $1\times10^{-5}$ mole, and most preferably from $2\times10^{-6}$ mole to $8\times10^{-6}$ mole. The above sulfur sensitizer, when to be incorporated into the emulsion, is dissolved into water or into an alcohol such as methanol, ethanol, or the like, and then the solution is added.

Examples of the foregoing gold compound to be used in the silver halide emulsion of this invention include chloroauric acid, sodium chloroaurate, gold-potassium thiosulfate, and the like, but are not limited to these compounds.

The adding amount of the gold compound of this invention is preferably from $5\times10^{-7}$ to $5\times10^{-3}$ mole per mole of silver halide, more preferably from $2\times10^{-6}$ to $1\times10^{-4}$ mole, further preferably from $2.6\times10^{-6}$ to $4\times10^{-5}$ mole, and most preferably from $2.6\times10^{-6}$ to $9\times10^{-6}$ mole.

The adding point of time of the gold compound of this invention should be in the period of time from immediately after the formation of the silver halide grains of this invention up to completion of the chemical sensitization.

Both the labile sulfur compound and the gold compound of this invention should be present at the time of the chemical sensitization of the high silver chloride-content silver halide grains of this invention, and, to be concrete, they should be present during the period of time from immediately after the formation of the above grains up to completion of the chemical sensitization.

In the present invention, as has been described above, the silver halide emulsion containing the high silver chloride-content silver halide emulsion of this invention is chemically sensitized in the presence of both the labile sulfur compound and the gold compound of this invention and further of the organic compound of this invention. As far as the latter chemical sensitization is concerned, methods therefor are described in, for example, British Pat. No. 1,315,755, Japanese Patent O.P.I. Publication Nos. 126526/1983 and 232545/1985, but what are described in these publications relate only to high silver bromide-content silver chlorobromide or iodobromide grains, but it was quite impossible for these publications to foresee the effect of this invention; i.e., the unique effect obtained in the high silver chloride content silver halide emulsion of this invention.

On the other hand, regarding the organic compound of this invention, it is well known to those skilled in the art that such an organic compound, for the purpose of preventing a silver halide light-sensitive material from being fogged or of improving the time stability or preservability of the light-sensitive material, is added to the emulsion at the time of completion of the chemical sensitization or in the stage following the same, but such the method of adding the compound after the chemical sensitization, which is out of this invention, is unable to obtain the effect of this invention.

The emulsion of this invention may be spectrally sensitized to any desired wavelength regions by using those dyes known as sensitizing dyes to those in the photographic field. Such sensitizing dyes may be used either alone or in combination of two or more of different types of them. Along with such sensitizing dyes, those dyes which in themselves have no spectral sensitization function or those compounds which do substantially not absorb any visible light but function as supersensitizers to enhance the sensitizing effect of sensitizing dyes may also be incorporated into the emulsion.

Where the silver halide emulsion of this invention should be used as a blue-sensitive emulsion, the emulsion is desirable to be spectrally sensitized by using any of those sensitizing dyes having the following Formula [A]:

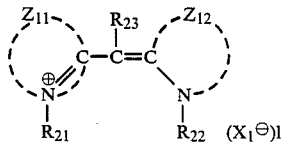

Formula [A]

wherein $Z_{11}$ and $Z_{12}$ each is a group of atoms necessary to form a benzoxazole nucleus, a naphthoxazole nucleus, a benzoselenazole nucleus, a naphthoselenazole nucleus, a benzothiazole nucleus, a naphthothiazole nucleus, a benzimidazole nucleus, a naphthoimidazole nucleus, a pyridine nucleus or quinonline nucleus, and these heterocyclic rings include those each having a substituent, the substituent being selected from the class consisting of halogen atoms, cyano group, methyl group, ethyl group, methoxy group and ethoxy group.

$R_{21}$ and $R_{22}$ each is an alkyl group, an alkenyl group, or an aryl group, and preferably an alkyl group, more preferably an alkyl group substituted by a carboxyl or sulfo group, and most preferably a sulfoalkyl group having 1 to 4 carbon atoms. And $R_{23}$ is a hydrogen atom or a group selected from the class consisting of methyl and ethyl groups. $X^{\ominus}$ is an anion, and 1 is an integer of 0 or 1.

Out of the sensitizing dyes having Formula [A], the particularly useful dyes are those sensitizing dyes having the following Formula [A']:

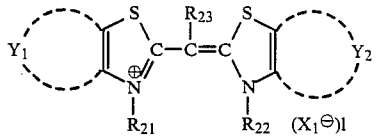

wherein $Y_1$ and $Y_2$ each is a group of atoms necessary complete a benzene ring or a naphthalene ring which each may have a substituent, the substituent being preferably a halogen atom or a group selected from the class consisting of cyano. methyl, ethyl, methoxy and ethoxy groups. $R_{21}$, $R_{22}$, $R_{23}$, $X^{\ominus}$ and 1 are as defined in Formula [A].

The following are examples of the sensitizing dyes having Formula [A] usable in this invention:

A-1

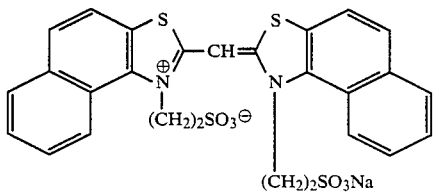

-continued

A-2

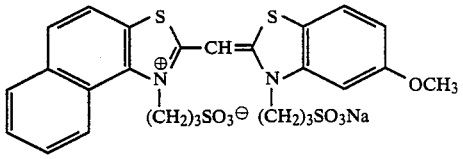

A-3

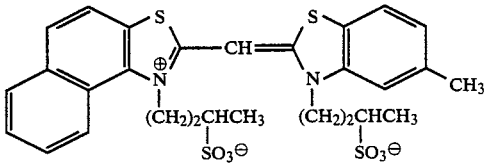

A-4

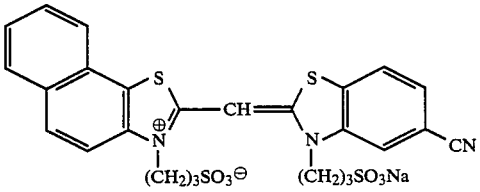

A-5

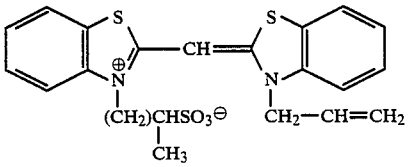

A-6

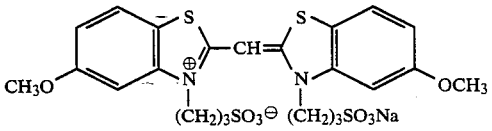

A-7

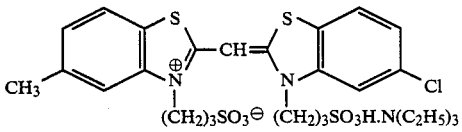

A-8

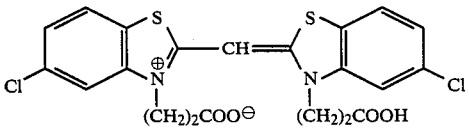

A-9

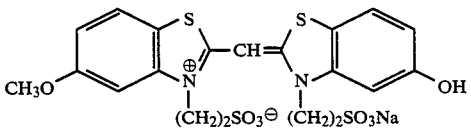

A-10

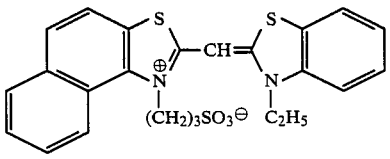

-continued

A-11

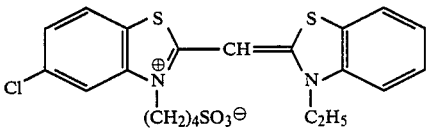

A-12

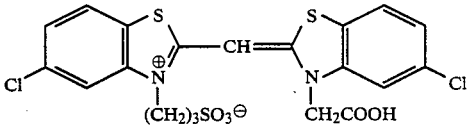

A-13

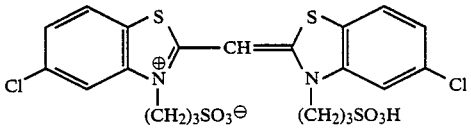

A-14

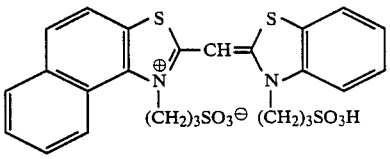

Where the silver halide emulsion of this invention is to be used as a green-sensitive emulsion, the emulsion is desirable to be spectrally sensitized by using any of those sensitizing dyes having the following Formula:

Formula [B]

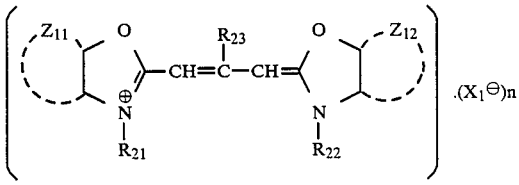

wherein $Z_{11}$ and $Z_{12}$ each is a group of atoms necessary to form a benzene ring or a naphthalene ring to be condensed with the oxazole ring, provided that the heterocyclic nuclei to be formed each may have a substituent, the substituent being preferably a halogen atom, an aryl, alkyl or alkoxy group, more preferably a halogen atom, a phenyl or methoxy group, and most preferably a phenyl group.

A suitable embodiment of this invention is such that $Z_{11}$ and $Z_{12}$ are benzene rings condensed with oxazole rings, and of these benzene rings at least one benzene ring is substituted at the 5th position thereof by a phenyl group, or one benzene ring is substituted at the 5th position thereof by a phenyl group and the other is substituted at the 5th position by a halogen atom.

$R_{21}$ and $R_{22}$ each is an alkyl, alkenyl or aryl group, preferably an alkyl group, more preferably an alkyl group substituted by a carboxyl or sulfo group, and most preferably a sulfoalkyl group having from 1 to 4 carbon atoms, and further, most preferably a sulfoethyl group.

$R_{23}$ is a hydrogen atom or an alkyl group having from 1 to 3 carbon atoms, and preferably a hydrogen atom or an ethyl group.

$X_1^{\ominus}$ represents an anion, for example, an ion of a halogen such as chlorine, bromine or iodine or an anion such as
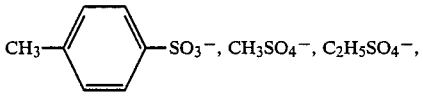
or the like; and n is an integer of 1 or 0, provided that when the compound forms an intramolecular salt, the n is 0.
The following are examples of the sensitizing dyes having Formula [B] which are suitably usable in this invention:
B-1
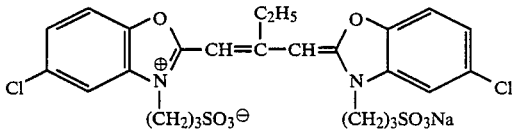
B-2
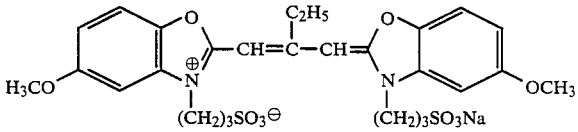
B-3
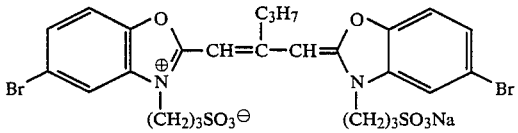
B-4
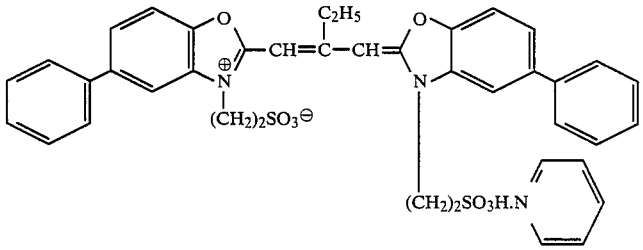
B-5
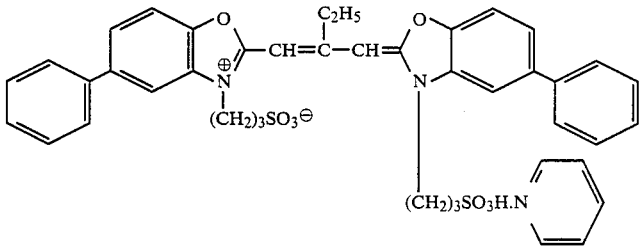
B-6
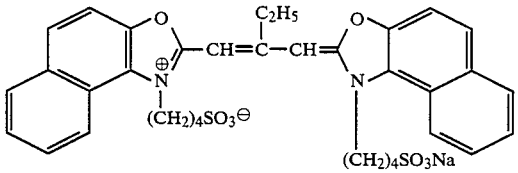
B-7
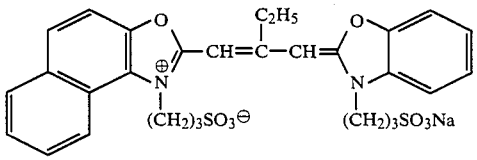

-continued

B-8

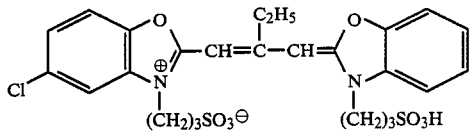

B-9

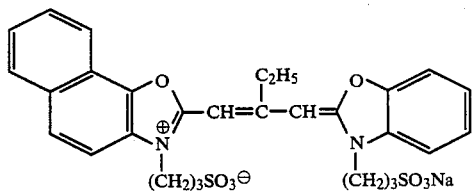

B-10

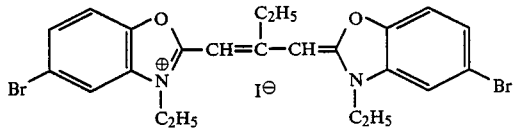

B-11

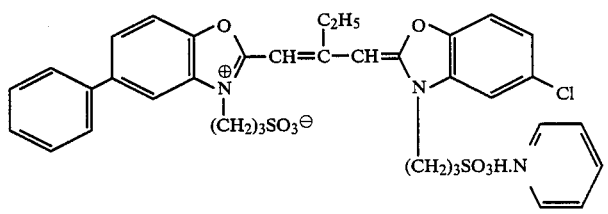

Where the silver halide emulsion of this invention is to be used as a red-sensitive emulsion, the emulsion is desirable to be_spectrally sensitized by any of those sensitizing dyes having the following Formula [C] or Formula [D]:

Formula [C]

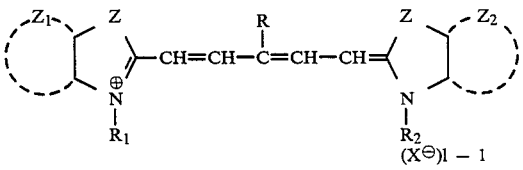

Formula [D]

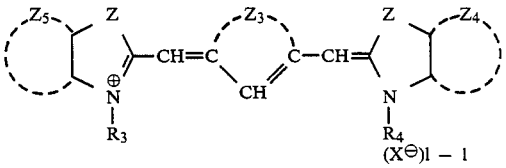

In Formula [C]]and Formula [D], R is a hydrogen atom or an alkyl group; $R_1$ through $R_4$ each is an alkyl group or an aryl group; $Z_1$, $Z_2$, $Z_4$ and $Z_5$ each is a group of atoms necessary to form a benzene or naphthalene ring condensed to a thiazole or selenazole ring; $Z_3$ is a group of hydrocarbon atoms necessary to form a 6-member ring; 1 is an integer of 1 or 2; Z is a sulfur atom or a selenium atom; and $X^{\ominus}$ is an anion.

In the above formulas, examples of the alkyl group represented by the R include methyl, ethyl and propyl groups, and the R is preferably a hydrogen atom, methyl group or ethyl group, and particularly preferably a hydrogen atom or ethyl group.

The $R_1$, $R_2$, $R_3$ and $R_4$ each is a group selected from the class consisting of straight-chain or branched-chaing alkyl groups (the alkyl group being allowed to have a substituent such as, e.g., methyl, ethyl, propyl, chloroethyl, hydroxyethyl. methoxyethyl, acetoxyethyl, carboxymethyl, carboxyethyl, ethoxycarbonylmethyl, sulfoethyl. sulfopropyl, sulfobutyl, β-hydroxy-γ-sulfopropyl, sulfate-propyl, allyl, benzyl or the like) and aryl groups (the aryl group is allowed to have a substituent such as, e.g., phenyl, carboxyphenyl, sulfophenyl or the like): the heterocyclic nucleus formed by the $Z_1$, $Z_2$, $Z_4$ or $Z_5$ is allowed to have a substituent which is preferably a halogen atom, aryl group or alkoxy group, and more preferably a halogen atom (e.g., a chlorine atom), phenyl group or methoxy group: and $X^{\ominus}$ is an anion (e.g., $Cl^-$, $Br^-$, $I^-$, $CH^3$— 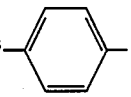 —$SO^{3-}$, $CH^3SO^{4-}$, $C^2H^5SO^{4-}$, or the like);

and 1 is an integer of 1 or 2, provided that when the compound forms an intramolecular salt, the 1 is 1).

The following are typical examples of the sensitizing dyes having Formula [C] and Formula [D] which are suitably usable in this invention:

C-1
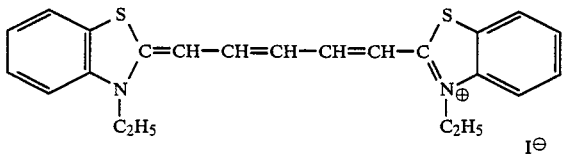
C-2
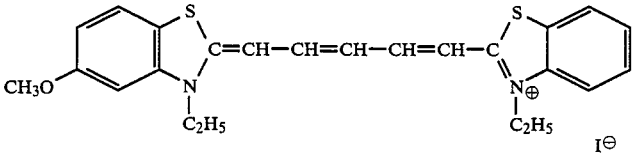
C-3
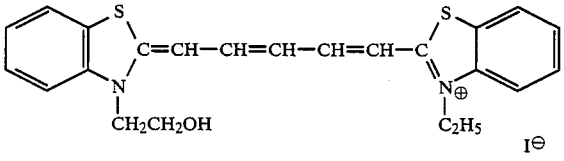
C-4
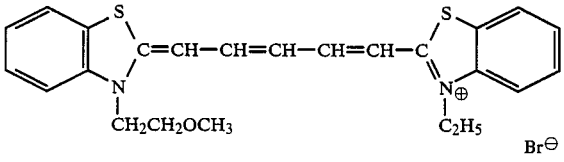
C-5
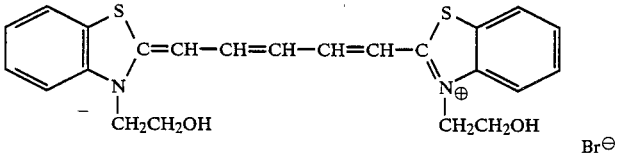
C-6
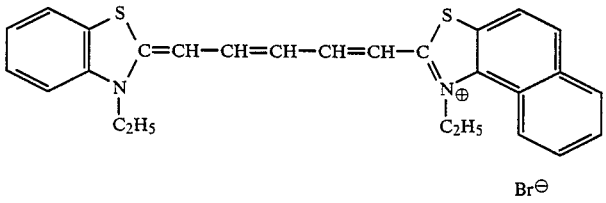
C-7
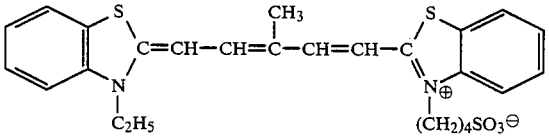
C-8
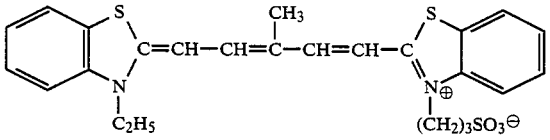
C-9
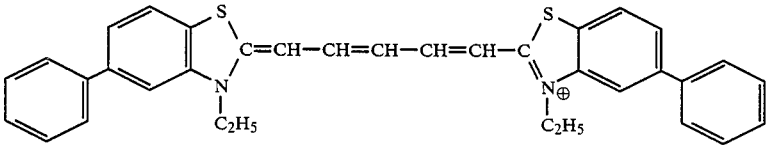

-continued
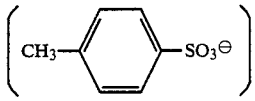
C-10
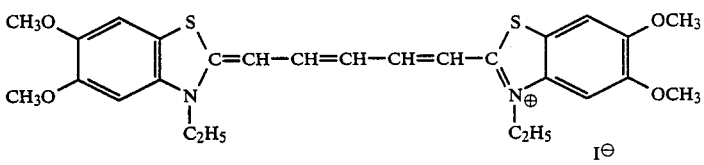
C-11
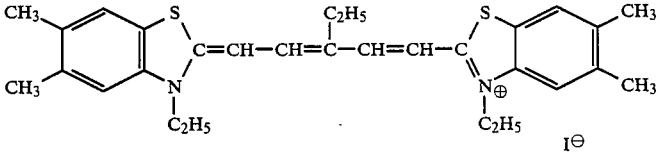
C-12
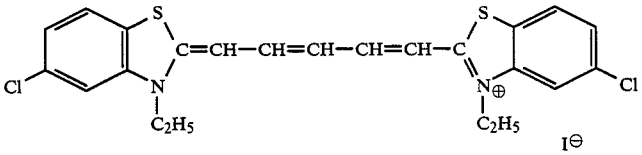
C-13
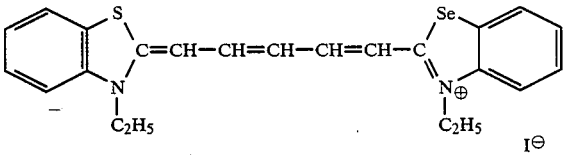
C-14
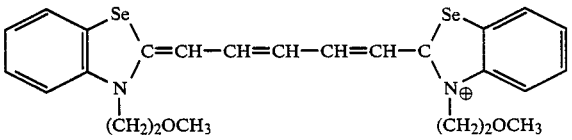
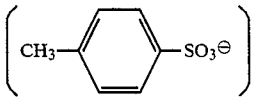
D-1
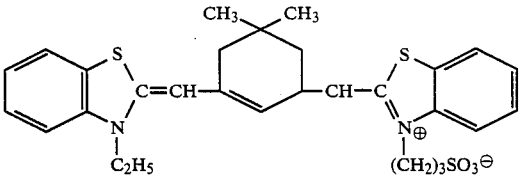
D-2
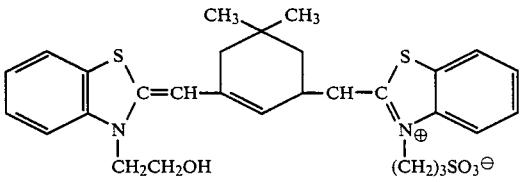

-continued

D-3

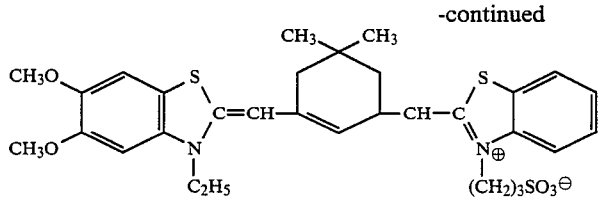

D-4

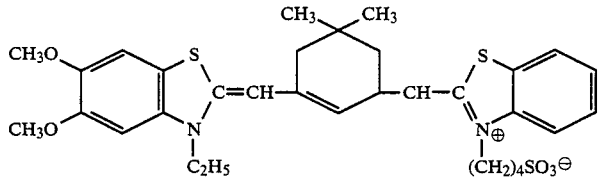

D-5

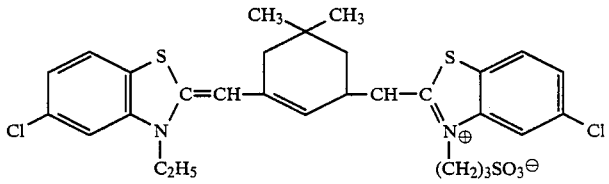

D-6

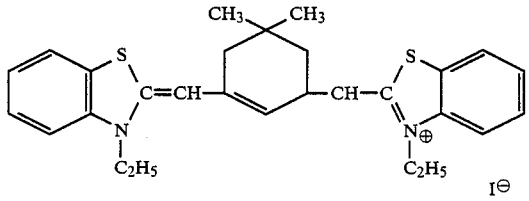

D-7

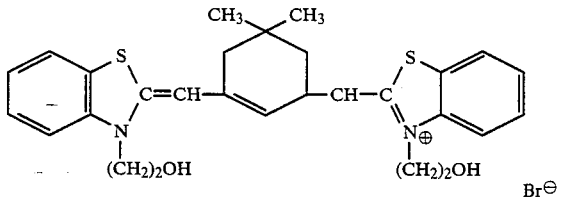

D-8

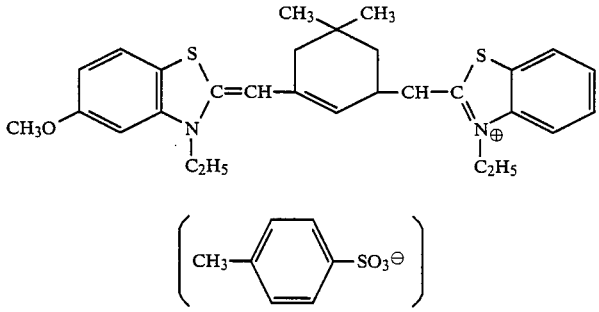

The adding amount of any of these sensitizing dyes having the above Formula [A], [B], [C] or [D], although not specially restricted, is preferably from $1\times10^{-7}$ to $1\times10^{-3}$ mole per mole of silver halide, and more preferably from $5\times10^{-6}$ to $5\times10^{-4}$ mole.

The addition of such sensitizing dyes may be performed in accordance with any of those methods well known to those skilled in the art.

For example, any of these sensitizing dyes may be first dissolved into a water-soluble solvent such as pyridine, methyl alcohol, ethyl alcohol. methyl cellosolve, aceton or the like (or a mixture of these solvents) or, in some cases, the solution is diluted by water, or, in some other cases, the dye is dissolved into water, and then, in the form of such a solution, may be incorporated into the emulsion. Ultrasonic oscillation can be advantageously used in dissolving such sensitizing dyes. Alternatively, any of the sensitizing dyes usable in this invention may also be added according to the method described in U.S. Pat. No. 3,496,987 which is such that a dye is first dissolved into a volatile organic solvent, and the solution is dispersed into a hydrophilic colloid, and then this dispersed product is added; or according to the method described in Japanese Patent Examined Publication No. 24185/1971 which is such that a water-insoluble dye, without being dissolved, is dispersed into a water-soluble solvent, and this dispersed liquid is then added. Also, the sensitizing dye usable in this invention may be added in the form of a dispersed product according to the acid dissolution dispersion method to the emulsion, and as the adding method, those methods as described in U.S. Pat. Nos. 2,912,345, 3,342,605, 2,996,287, 3,425,835, and the like may be used.

The sensitizing dyes to be incorporated into the emulsion of this invention may be dissolved into one and the same solvent or different solvents, and these solutions either may, prior to being added to the emulsion, be mixed and then added or may be separately added to the emulsion. When they are to be added separately, the adding order. points of time, and time intervals may be settled arbitrarily according to purposes. The addition of the sensitizing dye of this invention may be made at any discretional point or points of time during the course of preparation of the emulsion, but preferably during or after the chemical sensitization, and more preferably during the chemical sensitization.

The silver halide light-sensitive photographic material of this invention can be, for example, a color negative or positive film, color photographic paper, or the like, but the effect of the method of this invention is highly displayed particularly when the photographic material is used directly for appreciation.

The silver halide light-sensitive photographic material of this invention to be used as color photographic paper or the like may be for either monochromatic or multicolor use. In the case where the photographic material is a multicolor silver halide light-sensitive photographic material, in order to carry out color reproduction according to the subtractive method, it has a structure comprising usually an appropriate number of silver halide emulsion layers containing various photographic couplers such as magenta, yellow and cyan couplers and nonlight-sensitive layers provided by being superposed in an appropriate order on the support thereof. The number of such layers and the order of superposing the layers may be arbitrarily varied according to purposes for which the photographic material is used.

Where the present invention is applied to a multicolor light-sensitive photographic material, the particularly preferred layer construction is one having in order from the side of the support thereof an yellow dye image forming layer, intermediate layer, magenta dye image forming layer, intermediate layer, cyan dye image forming layer, intermediate layer and protective layer.

Dye image forming couplers usable in the silver halide light-sensitive photographic material of this invention, although not particularly restricted but various couplers may be used, include, as typical ones, those compounds as described in the following patent specifications:

Examples of the yellow dye image forming coupler of this invention include those acylacetamide-type and benzoylmethanetype 4-equivalent or 2-equivalent couplers as described in, e.g., U.S. Pat. Nos. 2,778,658, 2,875,057, 2,908,573, 2,908,513, 3,227,155, 3,227,550, 3,253,924, 3,265,506, 3,277,155, 3,341,331, 3,369,895, 3,384,657, 3,408,194, 3,415,652, 3,447,928, 3,551,155, 3,582,322 and 3,725,072, West German Pat. Nos. 1,547,868, 2,057,941, 2,162,899, 2,163,812, 2,213,461, 2,219,917, 2,261,361 and 2,263,875, Japanese Patent Examined Publication No. 13576/1974, Japanese Patent O.P.I. Publication Nos. 29432/1973, 66834/1973, 10736/1974, 122335/1974, 28834/1975, 132926/1975, 144240/1980 and 87041/1981.

Examples of the magenta dye image forming coupler of this invention include those 5-pyrazolone-type. pyrazolotriazole-type. pyrazolinobenzimidazole-type. indazolone-type and cyanoacetyl-type 4-equivalent or 2-equivalent magenta dye image forming couplers as described in, e.g., U.S. Pat. Nos. 2,600,788, 3,061,432, 3,062,653, 3,127,269, 3,311,476, 3,152,896, 3,419,391, 3,519,429, 3,555,318, 3,684,514, 3,705,896, 3,888,680, 3,907,571, 3,928,044, 3,930,861, 3,930,816 and 3,933,500, Japanese Patent O.P.I. Publication Nos. 29639/1974, 111631/1974, 129538/1974, 112341/1976, 58922/1977, 62454/1980, 118034/1980, 38643/1981 and 13584/1981, Japanese Patent Examined Publication Nos. 34937/1977, 29421/1980 and 35696/1980, British Pat. No. 1,247,493, Belgian Pat. No. 769,116, West German Pat. No. 2,156,111, Japanese Patent Examined Publication No. 60479/1971, Japanese Patent O.P.I. Publication Nos. 125732/1984, 228252/1984, 162548/1984, 171956/1984, 33552/1985 and 43659/1985, West German Pat. No. 1,071,030, and U.S Pat. No. 3,725,067.

Typical examples of the cyan dye image forming coupler of this invention include those phenol-type and naphthol-type 4-equivalent or 2-equivalent cyan dye image forming couplers as described in, e.g., U.S. Pat. Nos. 2,306,410, 2,356,475, 2,362,598, 2,367,531, 2,369,929, 2,423,730, 2,474,293, 2,476,008, 2,498,466, 2,545,687, 2,728,660, 2,772,162, 2,895,826, 2,976,146, 3,002,836, 3,419,390, 3,446,622, 3,476,563, 3,737,316, 3,758,308 and 3,839,044, British Pat. Nos. 478,991, 945,542, 1,084,480, 1,377,233, 1,388,024 and 1,543,040, and Japanese Patent O.P.I. Publication Nos. 37425/1972, 10135/1975, 25228/1975, 112038/1975, 117422/1975, 130441/1975, 6551/1976, 37647/1976, 52826/1976, 108841/1976, 109630/1978, 48237/1979, 66129/1979, 131931/1979, 32071/1980, 146050/1984, 31953/1984 and 117249/1985.

These dye forming couplers are desirable to have a group called a ballasting group having not less than 8 carbon atoms capable of making the coupler nondiffusible. These dye forming couplers may be either of 4-equivalent type, requiring 4 silver ions to be reduced for the formation of one molecular dye, or of 2-equivalent type, requiring only two silver ions to be reduced for the formation of one molecular dye.

As the binder (or protective colloid) of the silver halide light-sensitive photographic material of this invention, gelatin is advantageously used, but aside from gelatin, gelatin derivatives, graft polymers of gelatin with other high molecular materials, proteins, sugar derivatives, cellulose derivatives, and hydrophilic colloids such as synthetic hydrophilic high molecular materials being homo- or copolymers, and the like may also be used.

The silver halide light-sensitive photographic material of this invention may also use arbitrarily additives such as a hardening agent, anticolor-turbidity agent, image stabilizer. ultraviolet absorbing agent, plasticizer, latex, surface active agent, matting agent, lubricant, antistatic agent, and the like.

The silver halide light-sensitive photographic material of this invention is capable of forming a dye image by being processed by the color developing method known to those skilled in the art.

The color developing agent to be used in a color developer solution for use in developing the silver halide light-sensitive photographic material of this invention includes those aminophenol-type and p-phenylenediamine-type derivatives which are generally extensively used for various color photographic processes.

The color developer solution for use in color-developing the silver halide light-sensitive material of this invention may contain known compounds as the constituents for a developer solution in addition to the above primary aromatic amine-type color developing agent.

The pH value of such the color developer solution is normally not less than 7, and most generally about 10 to 13.

The color developing temperature is normally not less than 15° C. and generally from 20° to 50° C., but, for rapid processing, is desirable to be not less than 30° C. While the conventional developing period of time is from 3 to 4 minutes, the color developing period of time of the silver halide light-sensitive photographic material of this invention intended for rapid processing use is preferably in the range of generally 20 seconds to 60 seconds, and more preferably in the range of 30 seconds to 50 seconds.

The silver halide light-sensitive photographic material of this invention, after being color-developed, is bleached and fixed. The bleaching and fixing may also take place simultaneously.

The fixing process is usually followed by a washing process. In lieu of the washing process, a stabilization process may be applied, or both processes may be used in combination.

As has been described above, the silver halide light-sensitive photographic material of this invention is excellent in the aptitude for rapid processing. has a high sensitivity. and is hardly affected in the sensitivity and gradation by changes in the temperature at the time of exposure.

EXAMPLES

The present invention will be illustrated further in detail by the following examples. Embodiments of this invention are not limited to the examples.

EXAMPLE 1

Aqueous halide solutions comprised of aqueous silver nitrate solutions and potassium bromide and sodium chloride were mixed at 60° C. under a condition of pAg=7.0 in the presence of inert gelatin according to the method described in Japanese Patent O.P.I. Publication No. 45437/1984, whereby a monodisperse silver chlorobromide emulsion (EM-1) containing 50 mole % silver chloride was prepared. The EM-1, as a result of being observed through an electron microscope. was of silver halide grains in the cubic form whose average grain size (in sphere equivalent) was 0.71 μm.

Subsequently. under a condition of pAg=7.3, 95 mole % silver chloride-containing silver chlorobromide emulsion (EM-Z), 99.5 mole % silver chloride-containing silver chlorobromide emulsion (EM-3) and 100 mole % silver chloride-content silver chloride emulsion (EM-4) were prepared. The silver halide grains of these emulsions were each in the cubic form, and their average grain size was 0.70 μm for EM-2, 0.68 μm for EM-3 and 0.73 μm for EM-4.

After that, each of EM-1, EM-2, EM-3 and EM-4 was subjected to the following four addition treatments: To each of the emulsions (1) sodium thiosulfate alone was added. (2) sodium thiosulfate and chloroauric acid were added. (3) an organic compound of this invention (Exemplified Compound No. SB-5, whose solubility product with silver ions: $1\times10^{-14}$) was added immediately before the chemical sensitization thereof. and then sodium thiosulfate was added. and (4) the organic compound of this invention (SB-5) was added immediately before the chemical sensitization thereof. and further sodium thiosulfate and chloroauric acid were added. And each of all the emulsions was then spectrally sensitized by using a blue-sensitizing dye (Exemplified Compound No. A-12), and upon completion of the chemical sensitization. to each was added $1\times10^{-2}$ mole per mole of silver halide of another organic compound of this invention (Exemplified Compound No. SB-2, whose solubility product with silver ions: $1\times10^{-14.5}$), whereby emulsions No. EMB-1 through EMB-16 as given in Table-1 were prepared.

In addition, the adding amounts of the above-mentioned sodium thiosulfate, chloroauric acid and organic compound of this invention (Exemplified Compound No. SB-5) are also given in Table-1.

TABLE 1

| Blue-sensitive EM No. | Un-chemically ripened emulsion | Added amt of sodium thiosulfate (mol/mol AgX) | Added amt of chloroauric acid (mol/mol AgX) | Added amt of organic cpd of this invention (mol/mol AgX) |
|---|---|---|---|---|
| EMB-1 | EM-1 | $3.5\times10^{-6}$ | — | — |
| EMB-2 | EM-1 | $3.5\times10^{-6}$ | $2.7\times10^{-6}$ | — |
| EMB-3 | EM-1 | $3.5\times10^{-6}$ | — | $1.0\times10^{-4}$ |
| EMB-4 | EM-1 | $3.5\times10^{-6}$ | $2.7\times10^{-6}$ | $1.0\times10^{-4}$ |
| EMB-5 | EM-2 | $3.5\times10^{-6}$ | — | — |
| EMB-6 | EM-2 | $3.5\times10^{-6}$ | $2.7\times10^{-6}$ | — |
| EMB-7 | EM-2 | $3.5\times10^{-6}$ | — | $1.0\times10^{-4}$ |
| EMB-8 | EM-2 | $3.5\times10^{-6}$ | $2.7\times10^{-6}$ | $1.0\times10^{-4}$ |
| EMB-9 | EM-3 | $3.5\times10^{-6}$ | — | — |
| EMB-10 | EM-3 | $3.5\times10^{-6}$ | $2.7\times10^{-6}$ | — |
| EMB-11 | EM-3 | $3.5\times10^{-6}$ | — | $1.0\times10^{-4}$ |
| EMB-12 | EM-3 | $3.5\times10^{-6}$ | $2.7\times10^{-6}$ | $1.0\times10^{-4}$ |
| EMB-13 | EM-4 | $3.5\times10^{-6}$ | — | — |
| EMB-14 | EM-4 | $3.5\times10^{-6}$ | $2.7\times10^{-6}$ | — |
| EMB-15 | EM-4 | $3.5\times10^{-6}$ | — | $1.0\times10^{-4}$ |
| EMB-16 | EM-4 | $3.5\times10^{-6}$ | $2.7\times10^{-6}$ | $1.0\times10^{-4}$ |

Subsequently, the emulsions EMB-1 through EMB-16 were used as blue-sensitive emulsions to thereby prepare the following composition-having silver halide light-sensitive photographic materials, which were regarded as Sample-1 through Sample-16.

| | |
|---|---|
| Protective layer | Gelatin (5.0 g/m$^2$) |

-continued

| | |
|---|---|
| | Hardening agent (H-1) |
| Emulsion layer | Blue-sensitive emulsion (quantity of silver: 0.4 g/m$^2$)<br>Yellow coupler (Y-1: 0.80 g/m$^2$)<br>High-boiling organic solvent (Dioctyl phthalate: 0.4 g/m$^2$)<br>Gelatin (3.0 g/m$^2$) |
| Support | Polyethylene-laminated paper |

(H-1)

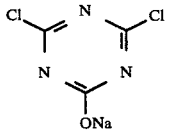

(Y-1)

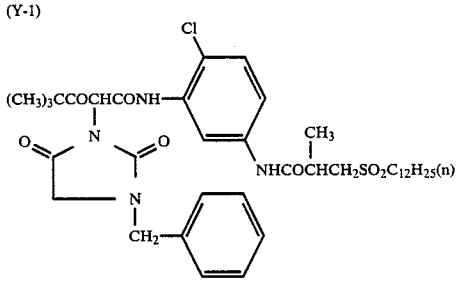

Each of the prepared Samples 1 through 16 was subjected to sensitometric evaluation according to the following procedure:

[Sensitometric Evaluation]

Each sample was subjected to exposures through an optical wedge to a white light by using a sensitometer (Model KS 7, manufactured by Konishiroku Photo Industry Co., Ltd.), provided that the exposures were made at varied temperatures of 10° C., 20° C. and 30° C. After that, each sample was processed by the following procedure:

| [Processing Steps] | Temperature | Time |
|---|---|---|
| Color developing | 34.7 ± 0.3° C. | 45 seconds |
| Bleach-fix | 34.7 ± 0.5° C. | 45 seconds |
| Stabilizing | 30–34° C. | 90 seconds |
| Drying | 60–80° C. | 60 seconds |

| (Color Developer Solution) | | |
|---|---|---|
| Pure water | 800 | ml |
| Ethylene glycol | 10 | ml |
| N,N—diethylhydroxylamine | 10 | g |
| Potassium chloride | 2 | g |
| N—ethyl-N—β-methanesulfonamidoethyl-3-methyl-4-aminoaniline nitrate | 5 | g |
| Sodium tetrapolyphosphate | 2 | g |
| Potassium carbonate | 30 | g |
| Brightening agent (4,4-diaminostilbene-disulfonic acid derivative) | 1 | g |
| Water to make 1 liter. | | |
| Adjust the pH to 10.8. | | |

| (Bleach-Fix Bath) | | |
|---|---|---|
| Ferric-ammonium ethylenediaminetetra-acetate, dihydrated | 60 | g |
| Ethylenediaminetetraacetic acid | 3 | g |
| Ammonium thiosulfate (70% solution) | 100 | ml |
| Ammonium sulfite (40% solution) | 27.5 | ml |
| Use potassium carbonate or glacial acetic acid to adjust the pH to 7.1, and add water to make 1 liter. | | |

| (Stabilizer Solution) | | |
|---|---|---|
| 5-Chloro-2-methyl-4-isothiazoline-3-one | 1 | g |
| 1-Hydroxyethylidene-1,1-diphosphonic acid | 2 | g |
| Water to make 1 liter. | | |
| Use sulfuric acid or potassium hydroxide to adjust the pH to 7.0. | | |

Each of the obtained samples was measured with respect to the reflection density thereof by using a densitometer PDA-65 (manufactured by Konishiroku Photo Industry Co., Ltd.). The sensitivity of each sample was expressed in terms of the reciprocal of the exposure necessary to obtain a density of 0.8, and given in a value relative to the sensitivity regarded as 100 of Sample-1 exposed at a temperature of 10° C. The gradation of each sample was given in terms of a tangent value for the inclination of a line connected between the density points 0.5 and 1.5 on the characteristic curve. The obtained results are as given in Table 2. In the table, the 'D max' represents the maximum reflection density of each sample.

TABLE 2

| | Temperature at the time of exposure | | | | | | Δ Sensitivity | |
|---|---|---|---|---|---|---|---|---|
| | 10° C. | | 20° C. | | 30° C. | | | |
| Sample No. | Sensitivity | Gradation | Sensitivity | Gradation | Sensitivity | Gradation | (30° C.–(0° C.) | D max |
| 1 (Com.) | 100 | 2.97 | 115 | 3.03 | 128 | 3.10 | 28 | 2.01 |
| 2 (Com.) | 142 | 2.85 | 159 | 2.91 | 171 | 2.98 | 29 | 2.04 |
| 3 (Com.) | 125 | 2.90 | 133 | 2.95 | 146 | 2.99 | 21 | 1.99 |
| 4 (Com.) | 180 | 2.82 | 192 | 2.84 | 203 | 2.87 | 23 | 2.03 |
| 5 (Com.) | 61 | 3.03 | 88 | 3.21 | 115 | 3.35 | 54 | 2.43 |
| 6 (Com.) | 103 | 3.09 | 141 | 3.29 | 169 | 3.42 | 66 | 2.45 |
| 7 (Com.) | 76 | 3.12 | 84 | 3.17 | 95 | 3.26 | 19 | 2.38 |
| 8 (Inv.) | 149 | 3.15 | 155 | 3.18 | 163 | 3.20 | 14 | 2.46 |
| 9 (Com.) | 59 | 3.11 | 90 | 3.30 | 109 | 3.39 | 50 | 2.40 |
| 10 (Com.) | 100 | 3.07 | 135 | 3.19 | 171 | 3.31 | 71 | 2.41 |
| 11 (Com.) | 85 | 3.10 | 94 | 3.21 | 102 | 3.29 | 17 | 2.43 |
| 12 (Inv.) | 152 | 3.11 | 159 | 3.15 | 161 | 3.17 | 9 | 2.49 |
| 13 (Com.) | 51 | 3.14 | 72 | 3.29 | 99 | 3.38 | 48 | 2.44 |
| 14 (Com.) | 102 | 3.01 | 133 | 3.17 | 169 | 3.30 | 67 | 2.45 |
| 15 (Com.) | 81 | 3.05 | 86 | 3.09 | 95 | 3.15 | 14 | 2.38 |
| 16 (Inv.) | 118 | 3.17 | 124 | 3.22 | 136 | 3.25 | 18 | 2.47 |

As is apparent from the results given in Table-2, Samples No. 1 to No. 4 using the high silver bromide-content comparative emulsions EMB-1 to EMB-4 are highly sensitive and stable in the dependence upon temperatures, but have low maximum densities and are lacking in the aptitude for rapid processing. Although those using the high silver chloride-content silver halide grains of this invention are satisfactory in respect of the aptitude for rapid processing, Samples Nos. 5, 9 and 13, obtained by adding sodium thiosulfate alone to the silver halide of this invention, are poor in the sensitivity and largely affected in the sensitivity as well as in the gradation by changes in the temperature at the time of exposure. Samples Nos. 6, 10 and 14, obtained by adding not only sodium thiosulfate but also the gold compound. although improved on the sensitivity to some degree as compared to the above Samples Nos. 5, 9 and 13, are significantly affected in the sensitivity as well as in the gradation by changes in the temperature at the time of exposure. Further, Samples Nos. 7, 11, and 15, and obtained by adding the organic compound of this invention and sodium thiosulfate, are so improved as to be less affected by the temperature at the time of exposure but have low sensitivities. In contrast, only Samples Nos. 8, 12 and 16 for this invention are excellent in the maximum density as well as in the aptitude for rapid processing, and show high sensitivities and little fluctuation of both sensitivity and gradation due to changes in the temperature at the time of exposure. thus being considered collectively excellent.

To be more precise, it is understood that out of these samples for this invention comprising high silver chloride content silver halide grains of this invention, Sample No. 12. which uses silver halide grains containing 0.5 mole % silver bromide, shows the most significant effect of this invention.

EXAMPLE 2

In similar manner to that of Example-1, silver chlorobromide containing 99.3 mole % silver chloride and comprised of silver halide cubic grains having a grain size of 0.3 μm was prepared. To this were added sodium thiosulfate and chloroauric acid as given in Table-3. and two minutes later then an organic compound of this invention (Exemplified Compound No. SB-5) in quantities varied. After that. each of the respective emulsions was optimally ripened and further color-sensitized by using a green-sensitizing dye (B-4), and to this. at the time of completion of the chemical sensitization, was added $1\times10^{-2}$ mole per mole of silver halide of the organic compound of this invention (No. SB-5, whereby green-sensitive emulsions EMG-1 through EMG-10 were prepared. And Samples No. 17 through No. 26 were then prepared in the same manner as in Example-1 except that the hereinafter mentioned CM-1 as a magenta coupler was used. These samples were each tested by varying the temperature at the time of exposure and evaluated in the same manner as in Example-1. The results are as given in Table-4.

TABLE 3

| Sample No. | Green-sensitive EM No. | Added amt of sodium thiosulfate (mol/mol AgX) | Added amt of chloro-auric acid (mol/mol AgX) | Added amt of organic cpd of this invention (mol/mol AgX) |
|---|---|---|---|---|
| 17 (Com.) | EMg-1 | $4.6\times10^{-6}$ | $3.5\times10^{-6}$ | — |
| 18 (Inv.) | EMG-2 | $4.0\times10^{-5}$ | $3.5\times10^{-6}$ | $1.5\times10^{-4}$ |
| 19 (Inv.) | EMG-3 | $4.0\times10^{-6}$ | $3.5\times10^{-6}$ | $1.5\times10^{-4}$ |
| 20 (Inv.) | EMG-4 | $4.0\times10^{-6}$ | $1.0\times10^{-6}$ | $1.5\times10^{-4}$ |
| 21 (Inv.) | EMG-5 | $4.0\times10^{-6}$ | $1.5\times10^{-5}$ | $1.5\times10^{-5}$ |
| 22 (Inv.) | EMG-6 | $4.0\times10^{-6}$ | $2.5\times10^{-6}$ | $1.5\times10^{-4}$ |
| 23 (Inv.) | EMG-7 | $4.0\times10^{-6}$ | $2.5\times10^{-6}$ | $5\times10^{-5}$ |
| 24 (Inv.) | EMG-8 | $4.0\times10^{-6}$ | $2.5\times10^{-6}$ | $5\times10^{-3}$ |
| 25 (Inv.) | EMG-9 | $4.0\times10^{-6}$ | $2.5\times10^{-6}$ | $2\times10^{-4}$ |
| 26 (Inv.) | EMG-10 | $4.0\times10^{-6}$ | $2.5\times10^{-6}$ | $3\times10^{-4}$ |

TABLE 4

| | Temperature at the time of exposure | | | | | | |
|---|---|---|---|---|---|---|---|
| | 10° C. | | 20° C. | | 30° C. | | |
| Sample No. | Sensitivity | Gradation | Sensitivity | Gradation | Sensitivity | Gradation | Δ Sensitivity (30° C.–20° C.) |
| 17 (Com.) | 100 | 3.45 | 141 | 3.72 | 169 | 3.91 | 69 |
| 18 (Inv.) | 83 | 3.50 | 89 | 3.53 | 97 | 3.59 | 14 |
| 19 (Inv.) | 121 | 3.48 | 130 | 3.52 | 133 | 3.56 | 12 |
| 20 (Inv.) | 139 | 3.38 | 148 | 3.49 | 164 | 3.57 | 25 |
| 21 (Inv.) | 97 | 3.51 | 110 | 3.60 | 126 | 3.72 | 29 |
| 22 (Inv.) | 140 | 3.47 | 143 | 3.53 | 150 | 3.56 | 10 |
| 23 (Inv.) | 132 | 3.55 | 147 | 3.67 | 164 | 3.78 | 32 |
| 24 (Inv.) | 72 | 3.49 | 79 | 3.53 | 87 | 3.56 | 15 |
| 25 (Inv.) | 130 | 3.54 | 134 | 3.58 | 139 | 3.62 | 9 |
| 26 (Inv.) | 128 | 3.51 | 131 | 3.55 | 139 | 3.56 | 11 |

As is apparent from Table-4, even in the green-sensitive emulsion layer, any of Samples Nos. 18 through 26 is stable in the sensitivity as well as in the gradation against changes in the temperature at the time of exposure. To be more precise, of these samples for this invention, Samples Nos. 19, 22, 25 and 26 are especially highly sensitive and remarkably excellent in the stability, showing very little fluctuation of the sensitivity and gradation due to changes in the temperature at the time of exposure.

Sample No. 17, obtained by adding the organic compound of this invention (Exemplified Compound No. SB-5) only at the time of completion of the chemical sensitization, shows large fluctuations of both the sensitivity and the gradation due to changes in the temperature at the time of exposure, so that it is understood that the effect of this invention cannot be obtained in the case where the organic compound is not present during the chemical sensitization.

EXAMPLE 3

Samples were prepared in the same manner as in Example-2 except that the chemically-unripened emulsion that was used in Example-2 was divided into seven parts and to the parts were added separately organic compounds of this invention, Exemplified Compounds SA-7, SB-1, SC-30, SC-39 and SD-5, and the following Comparative Compound* prior to the chemical sensitization of each part of the emulsion, and then the respective parts of the emulsion were chemically sensitized by the gold/sulfur sensitization, spectrally sensitized by using a red-sensitizing dye (C-6), and them was added the hereinafter described CC-1 as a cyan coupler. The results obtained by evaluating these samples are given in the following Table-6.

TABLE 5

| Red-sensitive emulsion No. | Organic compound of invention (product of solubilities of it and silver ions) |
|---|---|
| EMR-1 | None |
| EMR-2 | SA-7 ($2.1 \times 10^{-14}$) |
| EMR-3 | SB-1 ($1 \times 10^{-17}$) |
| EMR-4 | SC-30 ($1.87 \times 10^{-12}$) |
| EMR-5 | SC-39 ($5.2 \times 10^{-13}$) |
| EMR-6 | SD-5 ($3.4 \times 10^{-16}$) |
| EMR-7 | Comparative Compound* ($1.0 \times 10^{-10}$) |

Comparative Compound*

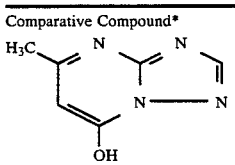

TABLE 6

| Sample No. | Red-sensitive EM No. | Temperature at the time of exposure 10° C. Sensitivity | 10° C. Gradation | 20° C. Sensitivity | 20° C. Gradation | 30° C. Sensitivity | 30° C. Gradation | Δ Sensitivity (30° C.-20° C.) |
|---|---|---|---|---|---|---|---|---|
| 27 (Com.) | EMR-1 | 100 | 4.02 | 120 | 4.25 | 145 | 4.31 | 45 |
| 28 (Inv.) | EMR-2 | 98 | 3.99 | 104 | 4.06 | 112 | 4.10 | 14 |
| 29 (Inv.) | EMR-3 | 165 | 4.13 | 168 | 4.18 | 172 | 4.22 | 7 |
| 30 (Inv.) | EMR-4 | 161 | 4.10 | 169 | 4.15 | 171 | 4.19 | 10 |
| 31 (Inv.) | EMR-5 | 95 | 3.95 | 100 | 4.03 | 109 | 4.10 | 14 |
| 32 (Inv.) | EMR-6 | 168 | 4.07 | 170 | 4.09 | 189 | 4.15 | 11 |
| 33 (Com.) | EMR-7 | 81 | 3.88 | 102 | 4.19 | 130 | 4.25 | 49 |

From the results in the above table it is understood that where the organic compounds of this invention which have Ksp values within the Ksp value range of this invention are used, the silver halide light-sensitive photographic material of this invention is hardly affected in the sensitivity as well as in the gradation by changes in the temperature at the time of exposure. and the effect of the organic compounds of this invention are excellent as compared to the comparative compound having a Ksp value which is outside the Ksp range of this invention.

EXAMPLE 4

Samples Nos. 34 and 35 were prepared in combination of those silver halide emulsions that were used in Examples-1, -2 and -3 and in accordance with the construction given in Table-7 and Table-8.

TABLE-7

| Sample | Blue-sensitive emulsion | Green-sensitive emulsion | Red-sensitive emulsion |
|---|---|---|---|
| 34 (Comparative) | EMB-10 | EMG-1 | EMR-1 |
| 35 (Invention) | EMB-12 | EMG-9 | EMR-3 |

TABLE-8

| Layer | Construction |
|---|---|
| Layer 7 (Protective layer) | Gelatin (10 mg/100 $cm^2$) Hardening agent (H-1) |
| Layer 6 (3rd interlayer) | Gelatin (10 mg/100 $cm^2$), Ultraviolet absorbing agents UV-1 (1 mg/100 $cm^2$) and UV-2 (2 mg/100 $cm^2$), Dioctyl phthalate (2 mg/100 $cm^2$) |
| Layer 5 (Red-sensitive layer | Gelatin (12 mg/100 $cm^2$), Red-sensitive emulsions (EMR-1, EMR-3) q'ty of silver (2.5 mg/100 $cm^2$), Cyan couplers (C-1/C-2)(0.4 mole per mole of silver halide), ioctyl phthalate (2 mg/100 $cm^2$) |
| Layer 4 (2nd interlayer) | Gelatin (15 mg/100 $cm^2$), Ultraviolet absorbing agents UV-1 (2 mg/100 $cm^2$) and UV-2 (5 mg/100 $cm^2$), Dioctyl phthalate (3 mg/100 $cm^2$) |
| Layer 3 (Green-sensitive layer) | Gelatin (15 mg/100 $cm^2$), Green-sensitive emulsions (EMG-1, EMG-9) q'ty of silver (3.5 mg/100 $cm^2$), Magenta coupler (M-1) (6 mg/100 $cm^2$), Dioctyl phthalate (2.5 mg/100 $cm^2$) |
| Layer 2 (Inter layer) | Gelatin (10 mg/100 $cm^2$) |
| Layer 1 (Blue-sensitive layer) | Gelatin (20 mg/100 $cm^2$), Blue-sensitive emulsion (q'ty of silver 3.0 mg/100 $cm^2$), Yellow coupler (8 mg/100 $cm^2$) Dinonyl phthalate (3 mg/100 $cm^2$) |
| Support | Polyethylene-laminated paper |

(CM-1)

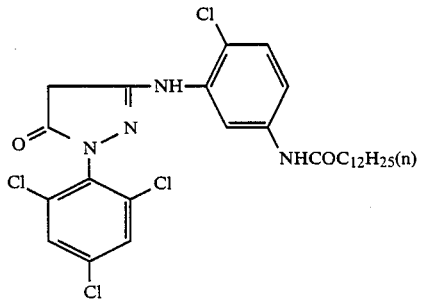

-continued

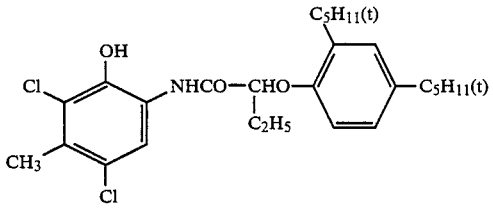

(CC-1)

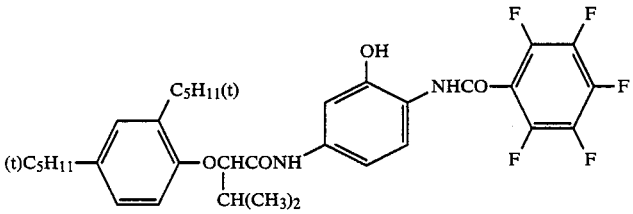

(CC-2)

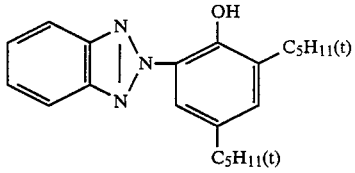

(UV-1)

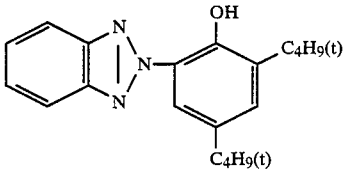

(UV-2)

These samples were examined in the same manners as in Examples-1, -2 and -3. The results are given in Table-9.

TABLE 9

| | | Temperature at the time of exposure | | | | | |
|---|---|---|---|---|---|---|---|
| | | 10° C. | | 20° C. | | 30° C. | |
| Sample | Layer | Sensitivity | Gradation | Sensitivity | Gradation | Sensitivity | Gradation |
| | Blue-sensitive layer | 100 | 2.93 | 142 | 3.11 | 167 | 3.30 |
| 34 (Com.) | Green-sensitive layer | 100 | 3.50 | 130 | 3.69 | 149 | 3.78 |
| | Red-sensitive layer | 100 | 4.01 | 119 | 4.12 | 138 | 4.29 |
| | Blue-sensitive layer | 151 | 3.01 | 159 | 3.08 | 163 | 3.12 |
| 35 (Inv.) | Green-sensitive layer | 142 | 3.52 | 145 | 3.55 | 150 | 3.58 |
| | Red-sensitive layer | 175 | 3.95 | 178 | 4.01 | 184 | 4.07 |

As is apparent from Table-9, the effect of this invention was confirmed even in the multilayered samples; that is, the sample of the construction of this invention is highly sensitive and hardly affected in the sensitivity by changes in the temperature at the time of exposure and also shows remarkably reduced imbalance in the sensitivity between the blue-, green- and red-sensitive layers as compared to the comparative sample.

What is claimed is:

1. A silver halide light-sensitive photographic material comprising a support and, provided thereon, a silver halide emulsion layer, wherein said silver halide emulsion layer contains silver-halide grains containing not less than 90 mole % of silver chloride and having been chemically sensitized in the presence of a labile sulfur compound and a gold compound, and an organic compound represented by formula

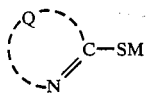

[S]

wherein Q is a group of atoms necessary to form a 5-member or 6-member heterocyclic ring or a benzene ring-condensed 5-member or 6-member heterocyclic ring, and M is a hydrogen atom or a cation wherein said organic compound has a solubility product(Ksp) with a silver ion of not more than $1\times10^{-11.0}$ and is added to said silver halide emulsion layer during the period between after the formation of said silver halide grains and before the completion of the chemical sensitization thereof.

2. The silver halide light-sensitive photographic material of claim 1, wherein said silver halide is selected from the group consisting of silver chlorobromide, silver iodochloride, silver chloroiodobromide and silver chloride.

3. The silver halide light-sensitive photographic material of claim 2, wherein said silver halide is selected from the group consisting of silver chlorobromide and silver chloride.

4. The silver halide light-sensitive photographic material of claim 2, wherein said silver halide is silver chlorobromide.

5. The silver halide light-sensitive photographic material of claim 1, wherein said Q is selected from the group consisting of an imidazole ring, a tetrazole ring, a thiazole ring, an oxazole ring, a selenazole ring, a benzimidazole ring, a naphthoimidazole ring, a benzothiazole ring, a naphthothiazole ring, a benzoselenazole ring, a naphthoselenazole ring, a benzoxazole ring and a naphthoxazole ring provided that these ring may have a substituent; and said M is a hydrogen atom or an alkali metal ion.

6. The silver halide light-sensitive photographic material of claim 1, wherein said compound has been added at a point of time during the period from immediately after the formation of the silver halide grains up to soon after the commencement of chemical sensitization.

7. The silver halide light-sensitive photographic material of claim 1, wherein said gold compound to be added is $5\times10^{-7}$ to $5\times10^{-3}$ mole per mole of silver halide.

8. The silver halide light-sensitive photographic material of claim 1, wherein said labile sulfur compound to be added is $1\times10^{-7}$ mole to $1\times10^{-1}$ mole per mole of silver halide.

9. The silver halide light-sensitive photographic material of claim 8, wherein said labile sulfur compound to be added is $1\times10^{-7}$ mole to $1\times10^{-1}$ mole per mole of silver halide.

* * * * *